US006669617B1

(12) United States Patent
Sumida et al.

(10) Patent No.: US 6,669,617 B1
(45) **Date of Patent: *Dec. 30, 2003**

(54) PAPER WEB FOLDING AND CUTTING APPARATUS

(75) Inventors: Masahiro Sumida, Chiba (JP); Yuichi Yamazaki, Chiba (JP)

(73) Assignee: Miyakoshi Printing Machinery Co., Ltd., Narashino (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 149 days.

(21) Appl. No.: 09/159,767

(22) Filed: Sep. 24, 1998

(30) Foreign Application Priority Data

Oct. 2, 1997 (JP) ..... 9-269598

(51) Int. Cl.[7] ..... B31B 1/14

(52) U.S. Cl. ..... 493/359; 493/360; 493/413; 493/414; 493/415

(58) Field of Search ..... 493/415, 414, 493/413, 357, 359, 360, 356

(56) References Cited

U.S. PATENT DOCUMENTS

| | | | | |
|---|---|---|---|---|
| 5,076,555 A | * | 12/1991 | Bunch, Jr. | 493/415 |
| 5,201,700 A | * | 4/1993 | Meschi | 493/415 |
| 5,348,527 A | * | 9/1994 | Beckwith | 493/415 |
| 5,616,113 A | * | 4/1997 | Van Den Bergh | 493/413 |
| 5,800,327 A | * | 9/1998 | Kishine et al. | 493/357 |

FOREIGN PATENT DOCUMENTS

| | | | |
|---|---|---|---|
| EP | 0 764 492 | | 3/1997 |
| JP | 5-41822 | | 6/1993 |
| JP | 8-18750 | | 2/1996 |
| JP | 9-76460 | | 3/1997 |
| JP | 09-076460 | * | 9/1997 |

* cited by examiner

*Primary Examiner*—Rinaldi I. Rada
*Assistant Examiner*—Christopher Harmon
(74) *Attorney, Agent, or Firm*—Wenderoth, Lind & Ponack, L.L.P.

(57) ABSTRACT

A paper web folding and cutting apparatus for a form printing machine includes a paper web traveling path which enables a continuous paper web to travel at a predetermined traveling speed. A cut portion forming device is disposed on the paper web traveling path and is adapted to form a cut portion formed in a line of a plurality of cuts. Each line of the cuts has at least one uncut portion, at every top and bottom directional dimension of the continuous paper web to be folded. Also, an oscillatory shooter assembly is disposed on the paper web traveling path on a downstream side of the cut forming means in a paper web traveling direction. The oscillatory shooter assembly is provided with a counter roller and a nozzle roller at a lower end portion thereof. The rollers are rotated at a peripheral speed which is faster than the paper web traveling speed, and the nozzle roller is movable into and out of contact with the counter roller. The oscillatory shooter assembly performs an oscillatory motion in a bilateral direction with the continuous paper web interposed between the nozzle roller and the counter roller so as to fold, in a zigzag fashion, the continuous paper web along the cut portions. According to this structure, the continuous paper web is cut along the cut portions by pressing the nozzle roller against the counter roller at a timing when the cut portion to be cut approaches an upstream side portion of both the nozzle roller and the counter roller.

10 Claims, 10 Drawing Sheets

PAPER WEB FOLDING AND CUTTING APPARATUS

BACKGROUND OF THE INVENTION

The present invention relates to a paper web folding and cutting apparatus particularly for a form printing press.

In a form printing press, a continuous web of paper is fed in a predetermined direction and, during this feeding, the continuous web of paper is sequentially printed and worked. Thereafter, the continuous web of paper is folded in a zigzag fashion by a folding and cutting apparatus including an oscillatory shooter assembly and is then cut into a predetermined number of pieces, of having a sheet or strip shape, and are then discharged.

The folding and cutting apparatus has a structure in which the continuous web paper is swung bilaterally by the oscillatory shooter assembly which swings bilaterally like a pendulum in a perpendicular plane, and according to such motion of the oscillatory shooter assembly, the continuous web of paper is worked or bent in a zigzag fashion at the folded portion, and then the paper is then piled.

The folded and piled continuous web of paper is thereafter cut into a predetermined number of sheets such as 500 sheets in one set, discharged on a conveyer, then packaged and shipped.

In a conventional form printing press, in order to fold the continuous web of paper, it is always required, at the working section, to form a cross line of perforations to top and bottom positions for folding of the continuous web paper for one sheet or strip before feeding to a folding apparatus and it is then folded by the folding apparatus. For example, Japanese Patent Publication No. HEI 8-18750 discloses a technique such that the continuous web of paper is automatically cut by means of a cutter knife along the cross line of perforations with a timing coincident with the folding of the continuous web of paper in the predetermined number of sheets, or Japanese Utility Model Laid-open Publication No. HEI 5-41811 discloses a technique such that the continuous web of paper is folded in a predetermined number of sheets and, then, the folded continuous web paper is cut along the cross line of perforations by pressing, against the continuous web of paper, a press roller and a tension roller rotating at a peripheral speed which is faster than a traveling speed of the continuous web of paper and then pulling the continuous web of paper to cut the same. Furthermore, Japanese Patent Laid-open Publication HEI 9-76460 discloses a technique in which cuts or notches are formed on and along the cross line of perforations of the continuous web of paper in an overlapped manner in coincidence with a timing of every predetermined number of sheets of the folded continuous web of paper. And, thereafter, a roller rotating at a peripheral speed which is faster than a travelling speed of the continuous web of paper is pressed against the continuous web of paper to thereby cut along the cut and the cross line of perforations.

As mentioned above, in the conventional folding and cutting apparatus of the form printing presses, it is always necessary to form cross lines of perforations to in the continuous web of paper, and then fold and cut the web along the cross lines of perforations.

However, in the conventional techniques mentioned above, the folding line coincides with the cross line of perforations, and hence, the thickness of the folded portion becomes larger than a combined thickness of two sheets of the continuous web of paper (called hereinlater, continuous paper web or simply paper web). Therefore, a set product of the folded and discharged continuous paper web has a protuberant portion at the folded portion along the cross line of perforations (i.e. both ends in the width direction of the folded paper web) and an upper surface of the product will be curled. If such curled product is fed for the next working such as bookbinding working, a certain trouble will be caused. Accordingly, in order to eliminate such trouble, it has been required to press down the curled portion manually or with pressing means so as to flatten the upper surface of the set product.

Furthermore, in a case where the cuts or notches are newly formed on the cross line of perforations, it is necessary to prepare, in addition to a cross line perforation forming means, a cutting means for forming the cuts and a control means for controlling the operations of contacting or separating the cutting means to or from an impression cylinder of a printing press, which will result in an undesired increase in costs.

SUMMARY OF THE INVENTION

An object of the present invention is to substantially eliminate defects or drawbacks encountered in the prior art mentioned above and to provide a folding and cutting apparatus of a form printing press, without the necessity of forming cross lines of perforations, capable of preventing a formation of a protuberant portion at a folded portion of a set product, which is then cut and discharged to thereby prevent any curled portion from being formed and easily cutting a continuous web of paper at predetermined positions.

This and other objects can be achieved according to the present invention by providing a paper web folding and cutting apparatus, comprising:

- a paper web traveling path enabling a continuous paper web to travel at a predetermined traveling speed;
- a cut portion forming means disposed on the paper web traveling path and adapted to form a cut portion formed as a line of a plurality of cuts, having at least one uncut portion, at every top and bottom directional dimension of the continuous paper web to be folded; and
- an oscillatory shooter assembly disposed on the paper web traveling path at a portion downstream side of the cut forming means in a paper web traveling directions. The oscillatory shooter assembly is provided with a counter roller and a nozzle roller at a lower end portion thereof. The counter roller and nozzle roller are rotated at a peripheral speed that is faster than the paper web traveling speed. The nozzle roller is contacted to and separated from the counter roller, and the oscillatory shooter assembly performs an oscillatory motion in a bilateral direction in a state that the continuous paper web is interposed between the nozzle roller and the counter roller so as to fold, in a zigzag fashion, the continuous paper web along the cut portions.

The continuous paper web is cut along the cut portions by pressing the nozzle roller against the counter roller at a timing just prior to when the cut portion to be cut approaches an upstream side portion of both the nozzle roller and counter roller.

In a preferred embodiment, the cut portion forming means for forming a cut portion comprises a paper web cut path disposed on an upstream side of the oscillatory shooter assembly and a cut cylinder assembly composed of an impression cylinder and a cut cylinder which are arranged on both sides of the paper web cut path in an opposed manner. The impression cylinder and the cut cylinder have substantially the same diameter and are rotated at the same peripheral speed in a paper web traveling direction with the continuous paper web being interposed therebetween. A cutting blade is mounted on the cut cylinder so as to extend in a longitudinal direction thereof for forming a line of cuts as the cut portion along which the continuous paper web is folded and cut. The cutting blade is formed with at least one cutout for forming at least one uncut portion at the cut portion.

The nozzle roller is supported by a frame member through a bearing means so as to be rotatable and a rotational center of the bearing means with respect to the frame member is offset from a rotational center of the nozzle roller.

The folding and cutting apparatus further includes a controller for controlling the timing for pressing the nozzle roller against the counter roller. The nozzle roller is pressed against the counter roller at a timing when a plurality of set sheets of the continuous paper web are folded by the oscillatory shooter assembly.

The folding and cutting apparatus of the characters described above is particularly applicable to a form printing press.

According to the present invention of the structures described above, the portion of the continuous paper web to be folded by the oscillatory shooter assembly is composed of a cut portion of a line having a long cut-in length and a small uncut portion in comparison with the formation of a cross line of perforations, which is a line composed of continuous fine holes, so that the continuous paper web can be bent and folded with no protuberant portion at the bent portion. The set of products discharged after the cutting do not produce any expanded or protuberant portion as well as no clearance, in which air may stay, between the piled folded portions, thus providing a product with no curl. Accordingly the operations and workings can be made easy and simple and members or parts to be used, such as a perforated cross line forming device, can be effectively reduced.

Furthermore, the continuous paper web can be easily cut at a predetermined portion along the long cuts.

The nature and further characteristic features of the present invention will be made more clear from the following descriptions with reference to the accompanying drawings.

BRIEF DESCRIPTION OF THE DRAWINGS

The present invention will become more under-standable from the following detailed description and with reference to the accompanying drawings representing a preferred embodiment of the present invention. Further, the embodiment shown in the drawings does not limit the present invention and is provided merely for the explanation and easy understanding of the present invention.

In the accompanying drawings.

DESCRIPTION OF THE PREFERRED EMBODIMENT

Figure 1:
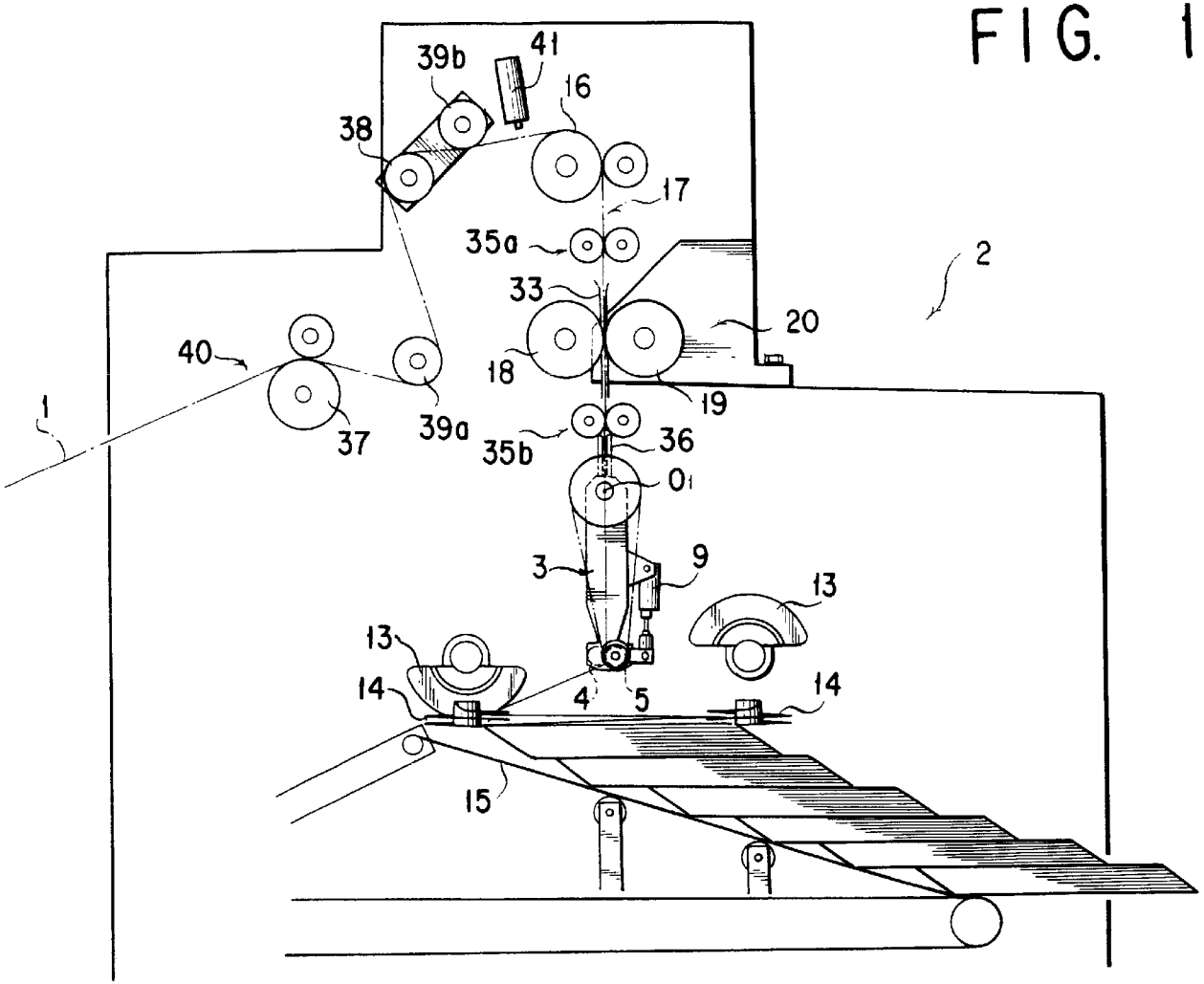
FIG. 1 is schematic view showing a structure of one embodiment of a paper folding and cutting apparatus of a form printing press according to the present invention.

A paper folding and cutting apparatus according to one preferred embodiment of the present invention preferably applicable to a form printing press will be described hereafter with reference to the accompanying drawings.

In the drawings, reference numeral 1 denotes a continuous web of paper (called hereinafter, continuous paper web, or simply, paper web), on which a predetermined picture pattern or the like is printed at a printing section not shown. Cut marks are marked to positions of every predetermined numbers of sheets for cutting, each consisting of a portion between one and next positions to be folded of the continuous web paper, by a marking member, not shown. The continuous paper web has no perforated cross lines as in the prior art.

Reference numeral 2 denotes a paper folding and cutting apparatus for folding the continuous paper web 1 with predetermined top and bottom dimensions and cutting the paper web 1 at the portion to be folded, at which the marking is made.

The continuous paper web 1 is fed along a paper web traveling path at a predetermined traveling speed.

Figure 2:
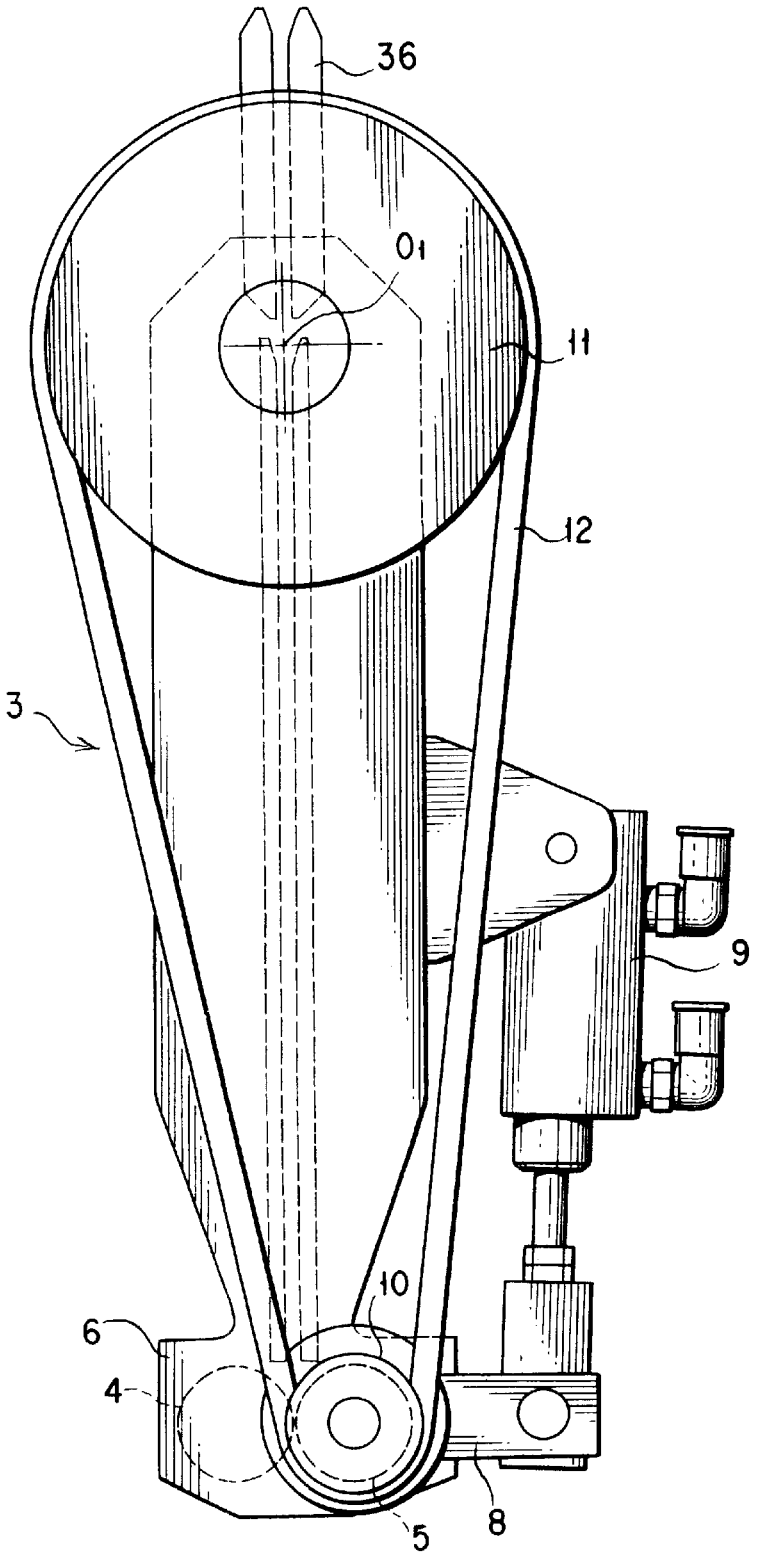
FIG. 2 is a front view of an oscillatory shooter assembly of the apparatus of FIG. 1.

The folding and cutting apparatus 2 is provided with an oscillatory shooter assembly 3, which is swingable in a pendulum motion in a perpendicular plane about a rotation fulcrum $O_1$ by a driving means, not shown. As shown in FIG. 2, a counter (pressure receive) roller 4 and a nozzle roller 5 opposed thereto are mounted on a front end portion of the oscillatory shooter assembly 3.

Figure 3:
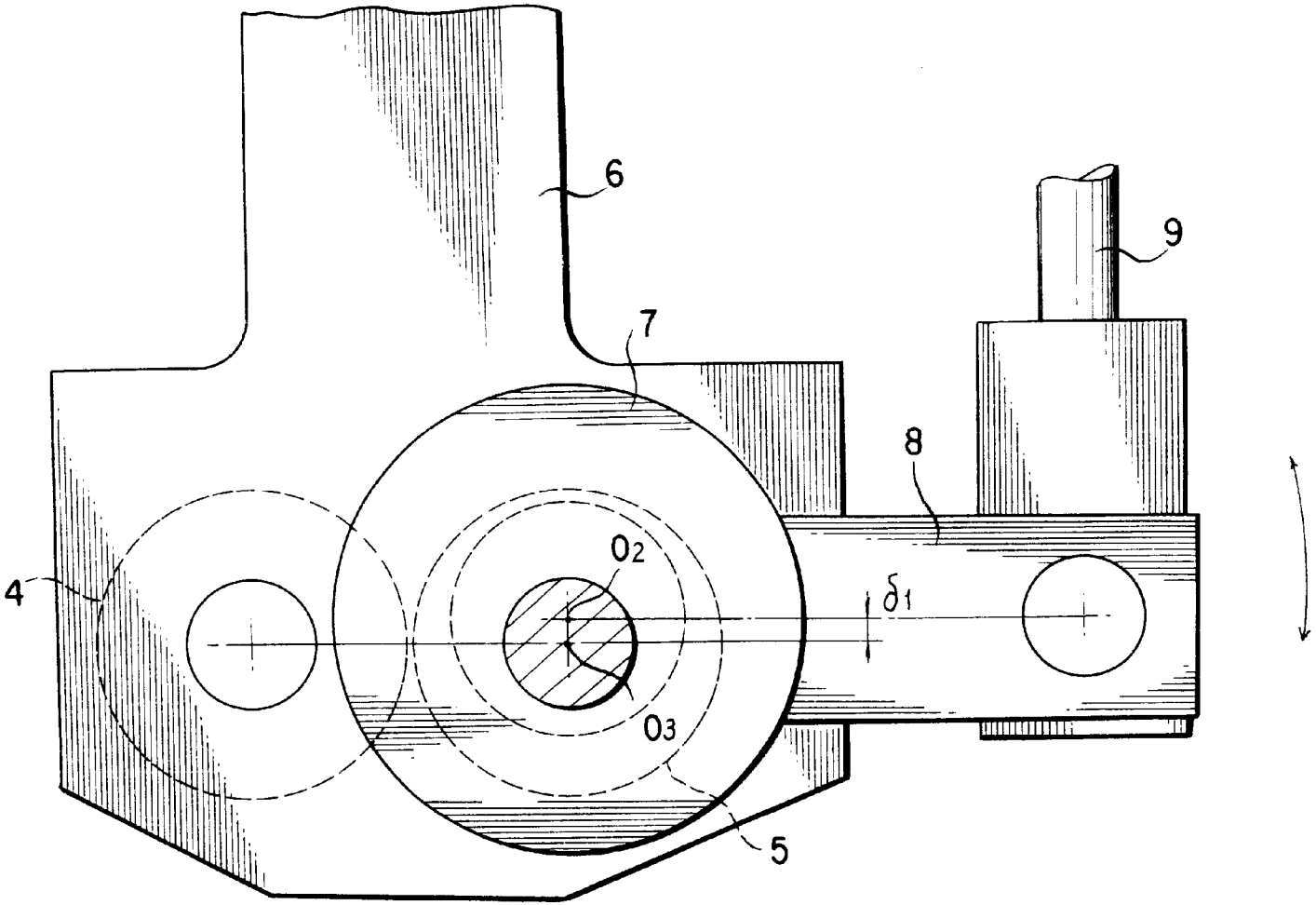
FIG. 3 is a schematic structural view of a nozzle roller of the apparatus of FIG. 1.
Figure 4:
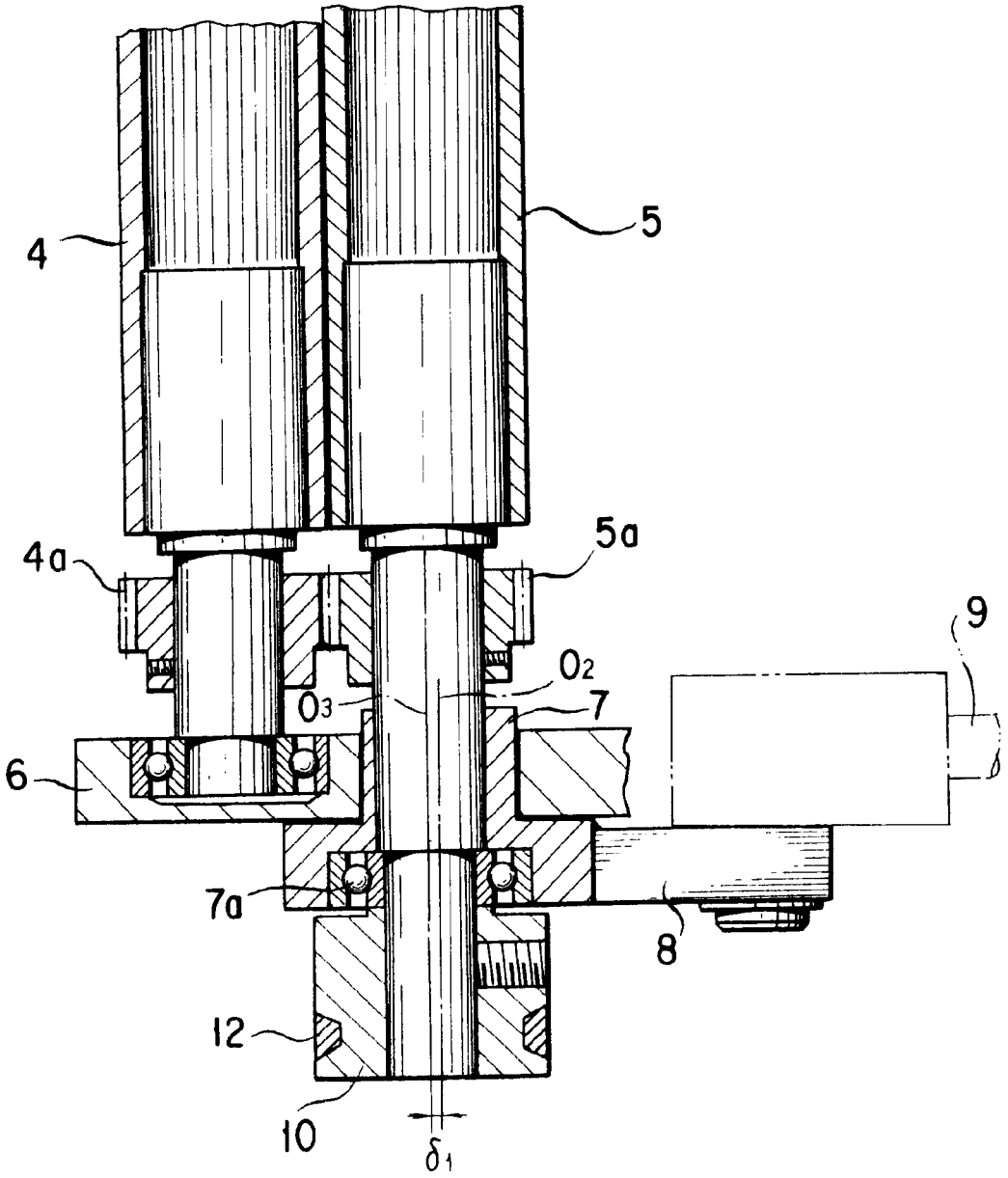
FIG. 4 is a horizontal sectional view of the nozzle roller.

The nozzle roller 5 and an associated structure is shown in FIG. 3 or FIG. 4 in which the counter roller 4 is supported by a shooter frame 6. The nozzle roller 5 is rotatably supported by the shooter frame 6 through a bearing box 7. The rotational center $O_2$ of the bearing box 7 with respect to the shooter frame 6 is slightly offset by an amount $\delta_1$ of eccentricity, for example, about 1 mm, with respect to the center of a bearing 7*a* received in the bearing box 7, that is, the rotational center $O_3$ of the nozzle roller 5.

An arm member 8 is provided for the bearing box 7 and an operation (working) cylinder 9 is coupled to the arm member 8. In the structure mentioned above, when the operation cylinder 9 is expanded or contracted, the bearing box 7 is rotated and the nozzle roller 5 is moved in a contacting direction contacting to (towards) or a separating direction (away) relative to the counter roller due to the existence of the amount $\delta_1$ of eccentricity.

That is, when the operation cylinder 9 is contracted, the nozzle roller 5 is moved to a position separated from the counter roller 4 by a small distance such as a distance further smaller than a thickness of the continuous paper web 1, this position being a called "first position". On the other hand, when the operation cylinder is extended, the nozzle roller is moved to a position forcibly contacting the counter roller 4, this position being called a "second position".

As shown in FIG. 2, a driven (follower) pulley 10 is secured to one end of a shaft to which the nozzle roller 5 is mounted, and the driven pulley 10 is coupled to a driving pulley 11, through a belt 12, which is disposed coaxially with the rotation fulcrum $O_1$ of the oscillatory shooter assembly 3. The driving pulley 11 is coupled to a power shaft of the folding and cutting apparatus 2 by means of a coupling member, not shown, in a manner such that the nozzle roller 5 is rotatably driven at a peripheral speed that is faster than the traveling speed of the continuous paper web 1.

The counter roller 4 and the nozzle roller 5 are coupled together by means of gears 4*a* and 5*a* so as to rotate together in the traveling direction of the paper web 1 at the same peripheral speed. Further, it is to be noted that although the gearing conditions of these gears 4*a* and 5*a* are changed by the eccentric motion of the nozzle roller 5, it causes substantially no problem because of extremely small change of the gearing condition.

As shown in FIG. 1, a pair of beaters 13, 13 and a pair of screws 14, 14 are arranged, respectively, on both sides of the swinging direction of the oscillatory shooter assembly 3. The beaters 13, 13 and the screws 14, 14 are operated in synchronism with the oscillatory motion of the oscillatory shooter assembly 3 so as to fold the continuous paper web 1 delivered from the shooter assembly 3. These structures are substantially the same as conventional structures. Further, reference numeral 15 denotes a conveyer.

An upstream side of the oscillatory shooter assembly 3 on the paper web traveling path is constructed as a paper web cut path 17 having a perpendicular structure from the oscillatory shooter assembly 3 to a pull roller 16. An impression cylinder 18 and a cut cylinder 19, which constitute a cut cylinder assembly 20, are arranged in an opposing manner with the paper web cut path 17 being interposed therebetween.

Figure 5:
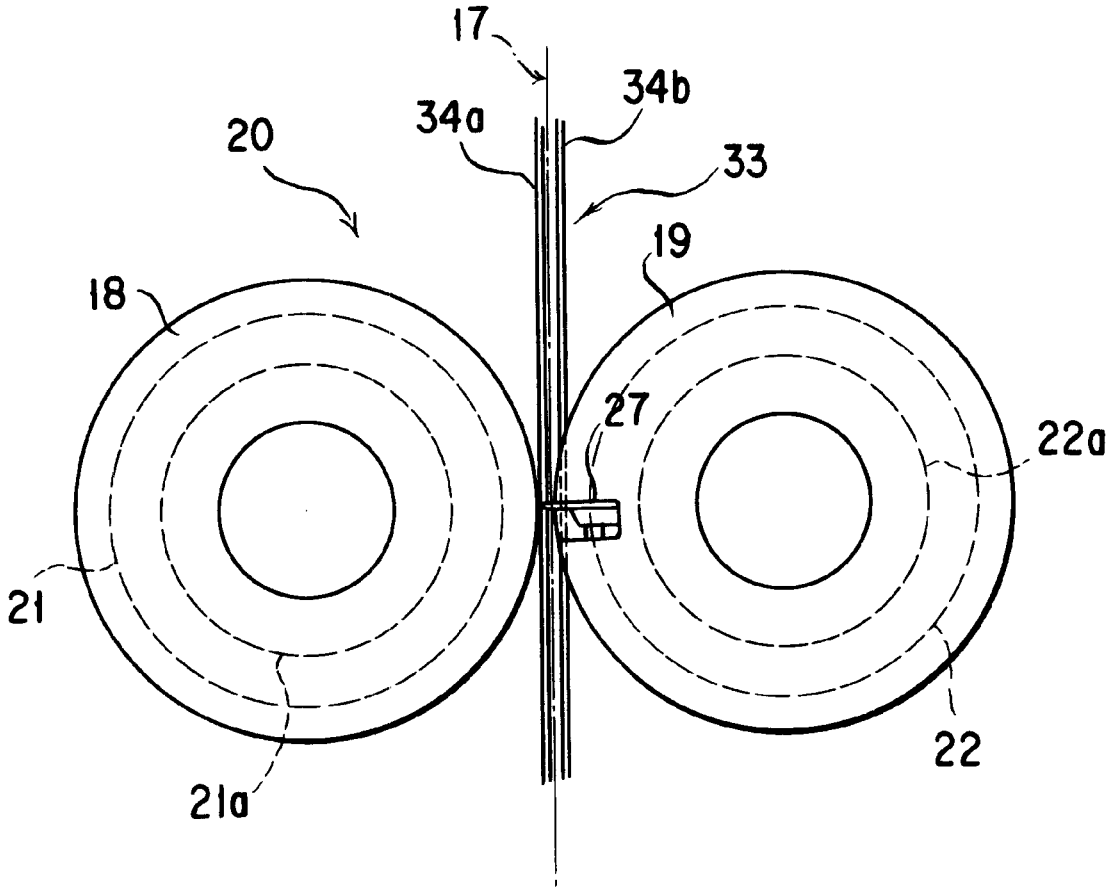
FIG. 5 is a schematic structural view of a cut cylinder assembly of the apparatus of FIG. 1.
Figure 6:
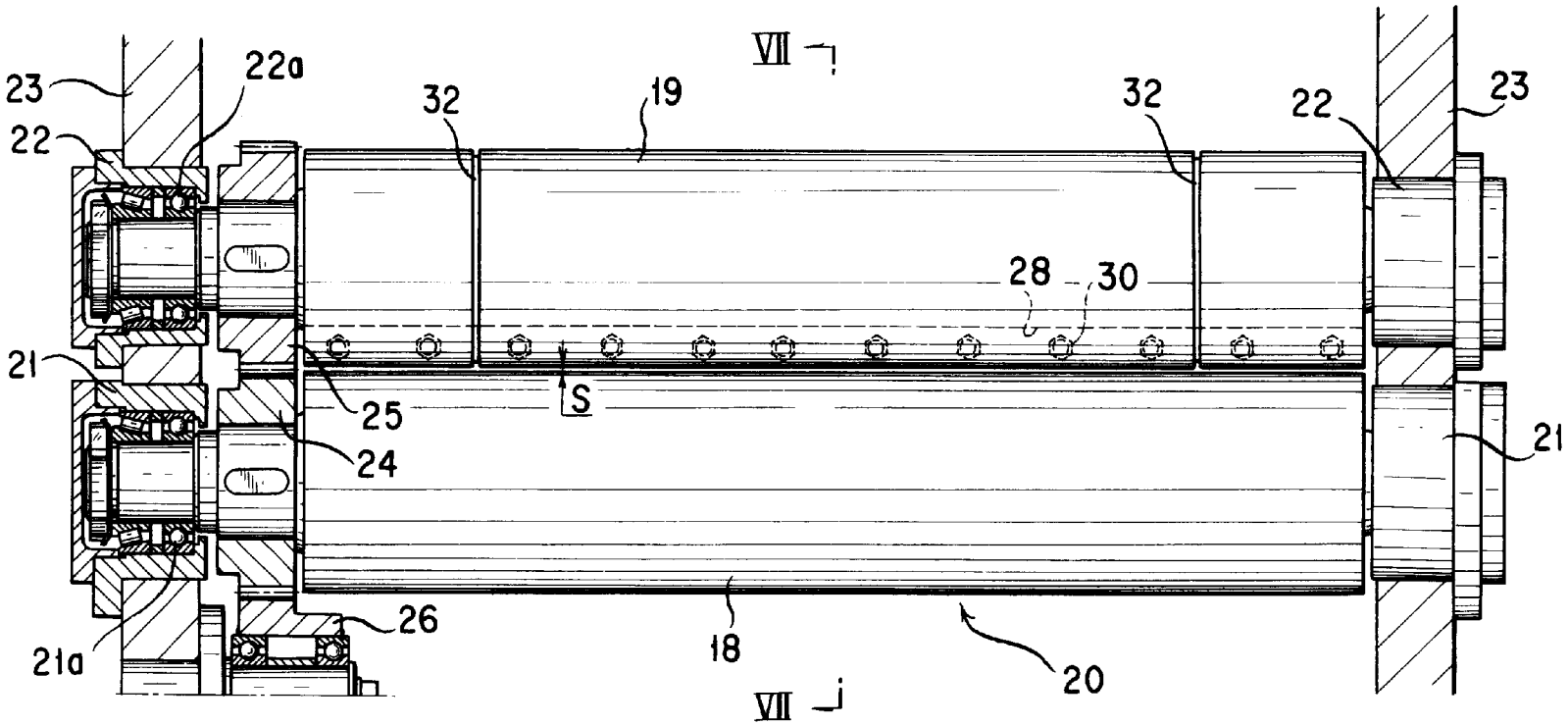
FIG. 6 is a sectional view of the cut cylinder assembly.
Figure 7:
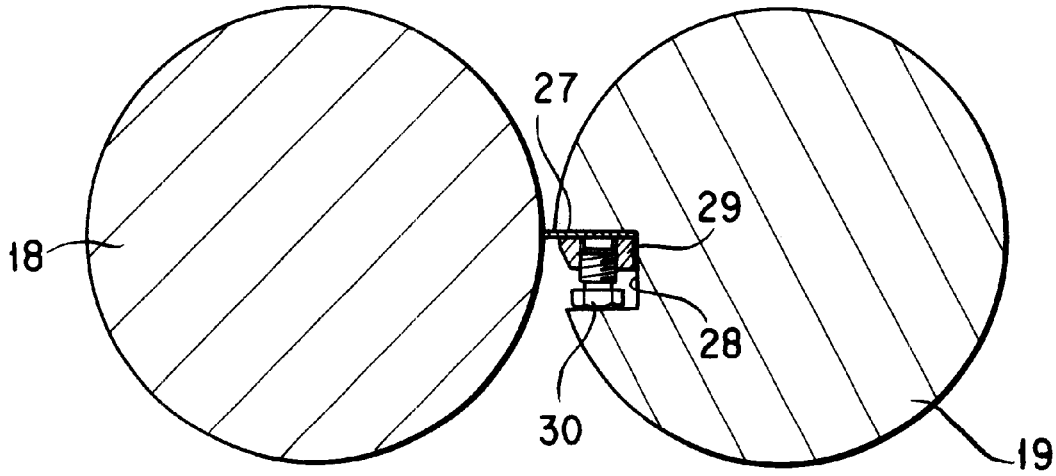
FIG. 7 is a sectional view taken along the line VII—VII in FIG. 6.

The cut cylinder assembly 20 has a structure shown in FIGS. 5 to 7, in which both end portions of the impression cylinder 18 and the cut cylinder 19 are respectively supported by front and rear frames 23 so as to be rotatable through bearing boxes 21 and 22 in which bearings 21*a* and 22*a* are housed. In the illustrated example, the impression cylinder 18 and the cut cylinder 19 have the same diameter. Gears 24 and 25 are mounted on the impression cylinder 18 and the cut cylinder 19, respectively, and the gear 24 mounted on the impression cylinder 18 is meshed with a driving gear 26. The impression cylinder 18 and the cut cylinder 19 are rotatably driven by driving gear 26 through the gears 24 and 25 at the same peripheral speed in the traveling direction of the paper web 1 in a manner such that opposing surfaces of cylinders 18 and 19 clamp the paper web 1 therebetween. The bearings 21*a* and 22*a* supporting the impression cylinder 18 and the cut cylinder 19 may be arranged so as to be directly supported by the frames 23, 23.

The cut cylinder 19 is provided with a groove 28 formed in a peripheral surface thereof so as to extend in a longitudinal, i.e. axial, direction of the cut cylinder. Also, a full-edge-type cutting blade 27, having a length extending over the full length of the cut cylinder 19, is fitted in the groove 28 and secured by a push plate 29 and a push bolt 30. The cutting blade 27 projects outward from the peripheral surface of the cut cylinder 19 by a length corresponding to a clearance S between the impression cylinder 18 and the cut cylinder 19.

Figure 8:
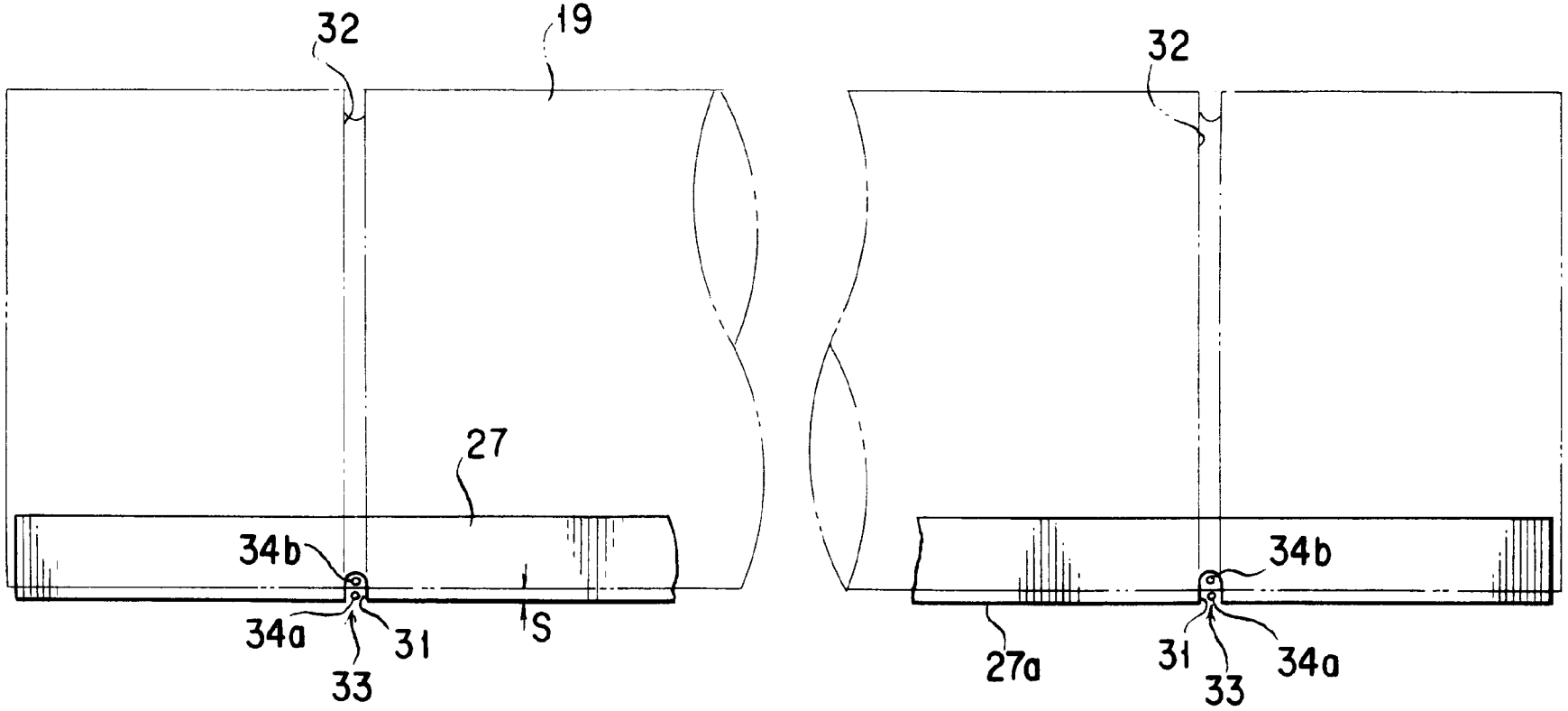
FIG. 8 is a plan view showing a cutting blade of the apparatus of FIG. 1.

The cutting blade 27 has a structure shown in FIG. 8 and is provided with a blade edge 27*a* formed along the entire length of the blade 27 with at least one, for example, two in the illustration of FIG. 8, cutout 31 having a depth that is greater than the projecting length S of the blade 27.

Grooves 32 are formed in the peripheral surface of the cut cylinder 19 at positions corresponding to the cutouts 31 of the blade 27.

A paper web guide assembly 33, for guiding the traveling of the continuous paper web 1 running along the paper web cut path 17, is arranged to a portion perpendicular to the cut cylinder assembly 20.

The paper web guide assembly 33 is composed of two guide wires 34*a* and 34*b* arranged oppositely to each other with respect to the paper web cut path 17 which is interposed therebetween. The guide wires 34*a* and 34*b* are disposed in the cutouts 31 formed in the cutting blade 27, respectively, as shown in FIGS. 5 to 8.

Guide roller assemblies 35*a* and 35*b* are provided on upstream and downstream sides of the cut cylinder assembly 20, respectively. Each roller assembly includes a pair of rollers arranged on opposite sides of the paper web cut path 17, respectively. Also, a guide device 36 is provided by arranging a plate member between the oscillatory shooter assembly 3 and the lower guide roller assembly 35*b*.

A paper web guide path 40 is arranged on the upstream side of the paper web cut path 17, and the paper web guide path 40 includes pull rollers 16, 37, a compensation roller 38, and guide rollers 39*a*, 39*b*. A mark sensor 41 is disposed at a position close to the guide roller 39*b* between the pull roller 16 and the compensation roller 38 of the paper web guide path 40.

The cylinder diameter of the cut cylinder 19 of the cut cylinder assembly 20 is determined by the top and bottom dimension of the continuous paper web 1 to be folded as one sheet, i.e. the folding pitch thereof.

That is, the diameter of the cut cylinder 19 is determined such that the peripheral dimension of the cut cylinder 19 is substantially equal to the top and bottom dimension, i.e. folding pitch of the paper web 1. Also, the rotational phase of the cut cylinder 19 is determined such that the cutting blade 27 abuts against the continuous paper web 1 and performs the cutting operation with the blade edge 27*a* at the time when the folded portion of the continuous paper web 1 is fed to a portion between both cylinders 18 and 19.

Further, when it is required to change the top and bottom dimension, i.e. folding pitch, the cut cylinder 19 may be exchanged. For this reason, the cut cylinder 19 may have a cassette-type structure capable of being exchanged with respect to the frames 23 of the folding and cutting apparatus 2, and in such case, the cut cylinder 19 is exchanged together with sub-frames (not shown) for supporting both the ends of the cut cylinder 19.

Further, it is to be noted that the operations of the respective members and/or assemblies in association with the traveling of the continuous paper web 1 in the described embodiment can be controlled by a control means or the like which is known in this art field in such a manner, for example, that the cut marks of the continuous paper web 1 are counted by a counter, which generates count signals, and operations signals are then generated to the respective members and assemblies through a controller in association with timings indicated by the counter.

The paper web folding and cutting apparatus of the structure according to the embodiment described above will operate in the following manner.

The continuous paper web 1 is fed along the paper web traveling path at a predetermined traveling speed.

Figure 9:
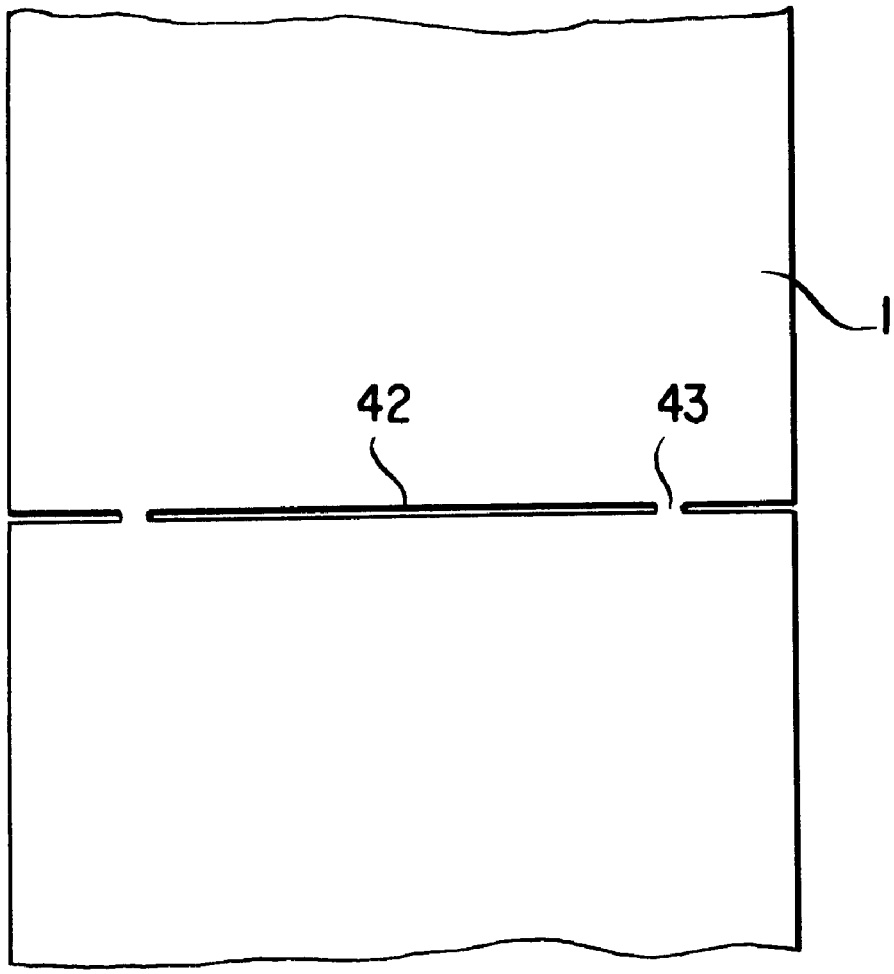
FIG. 9 is a front view of a portion of a continuous web of paper formed with a line of cuts.

The continuous paper web 1, which is printed and marked in a printing section but has no perforated cross lines, is pulled into the paper web folding and cutting apparatus by means of the pull rollers 16 and 37. The continuous paper web 1 is fed to the paper web cut path 17 through the pull roller 37, the guide roller 39*a*, the compensation roller 38, the guide roller 39*b* and the pull roller 16 in this order. Then, in the cut cylinder assembly 20, cuts 42 shown in FIG. 9 are formed at every top and bottom dimension for folding and/or cutting. Following this operation, portions corresponding to the cutouts 31 of the cutting blade 27 remain so as to provide each at least each uncut portion 43 with respect to one line of the cuts 42. That is, the cut portion is composed of the cuts 42, which each having a long cut-in length, and small uncut portions 43, whereas, in the prior art mentioned in the introduction of this specification, the cut portion is composed of a cross line of perforations (fine holes) and the cuts formed in an overlapped manner.

The continuous paper web 1, provided with the cuts 42, passes the paper web guide assembly 33 composed of the wires 34*a*, 34*b* and is then delivered in a zigzag fashion from the nozzle roller 5 in accordance with the oscillatory motion of the oscillatory shooter assembly 3. The continuous paper web 1 is then bent and folded along the cuts 42 and is thereafter piled up above the conveyer by the beaters 13, 13 and the screws 14, 14 while pressing down the portions at which the cuts 42 are formed.

During this operation, the continuous paper web 1 is bent and folded at the portions at which the cuts 42 are formed and small uncut portions remain, so that the continuous paper web 1, formed with cuts 42 and uncuts 43, can be more easily bent in comparison with paper webs formed with the cross lines of perforations, and moreover, can be folded with less expansion because of the existence of the uncuts 43, thus being substantially completely folded and piled up. Furthermore, because air can be easily discharged through the cuts 42, the expansion at the bent portions can be effectively prevented without forming curled portions at the upper surface of folded and piled set products.

In the state mentioned above, when a cut mark on to the continuous paper web 1 is detected by the mark sensor 41, a detection signal is outputted and the counting of an encoder signal due to this detection signal starts to be counted. And, as the cuts 42 approach the nozzle roller 5, the operation cylinder 9 of the nozzle roller 5 extends and the continuous paper web 1 is pressed against the counter roller 4 by the nozzle roller 5.

According to such operation, the portion of the continuous paper web 1 on the downstream side of the cuts 42 thereof is pulled under tension by the nozzle roller 5 and the counter roller 4 and the uncuts 43 are therefore torn. Accordingly, the continuous paper web 1 can be cut along the cut portion formed with the cuts 42 and uncuts 43.

After the operation mentioned above, the movement of operation cylinder 9 is immediately reversed in the eccentric manner in the direction to release the pressing force of the nozzle roller 5 on the counter roller 4. Accordingly, the front end portion of the cut continuous paper web 1 is swung outward by the nozzle roller as it is.

On the other hand, the cut portion of the continuous paper web 1 is quickly pressed by means of the beaters 13, 13 and the screws 14, 14, so that the cut paper web can be folded clearly without being disturbed.

The impression cylinder 18 and the cut cylinder 19 of the cut cylinder assembly 20 are connected to an output shaft of a printing press including the folding and cutting apparatus, the rotational speeds of these cylinders 18 and 19 are set so that the peripheral speeds thereof substantially accord with the traveling speed of the continuous paper web 1, and as previously mentioned the peripheral length of the cut cylinder 19 is made equal to the interval between the bent portions of the continuous paper web 1.

Figure 10:
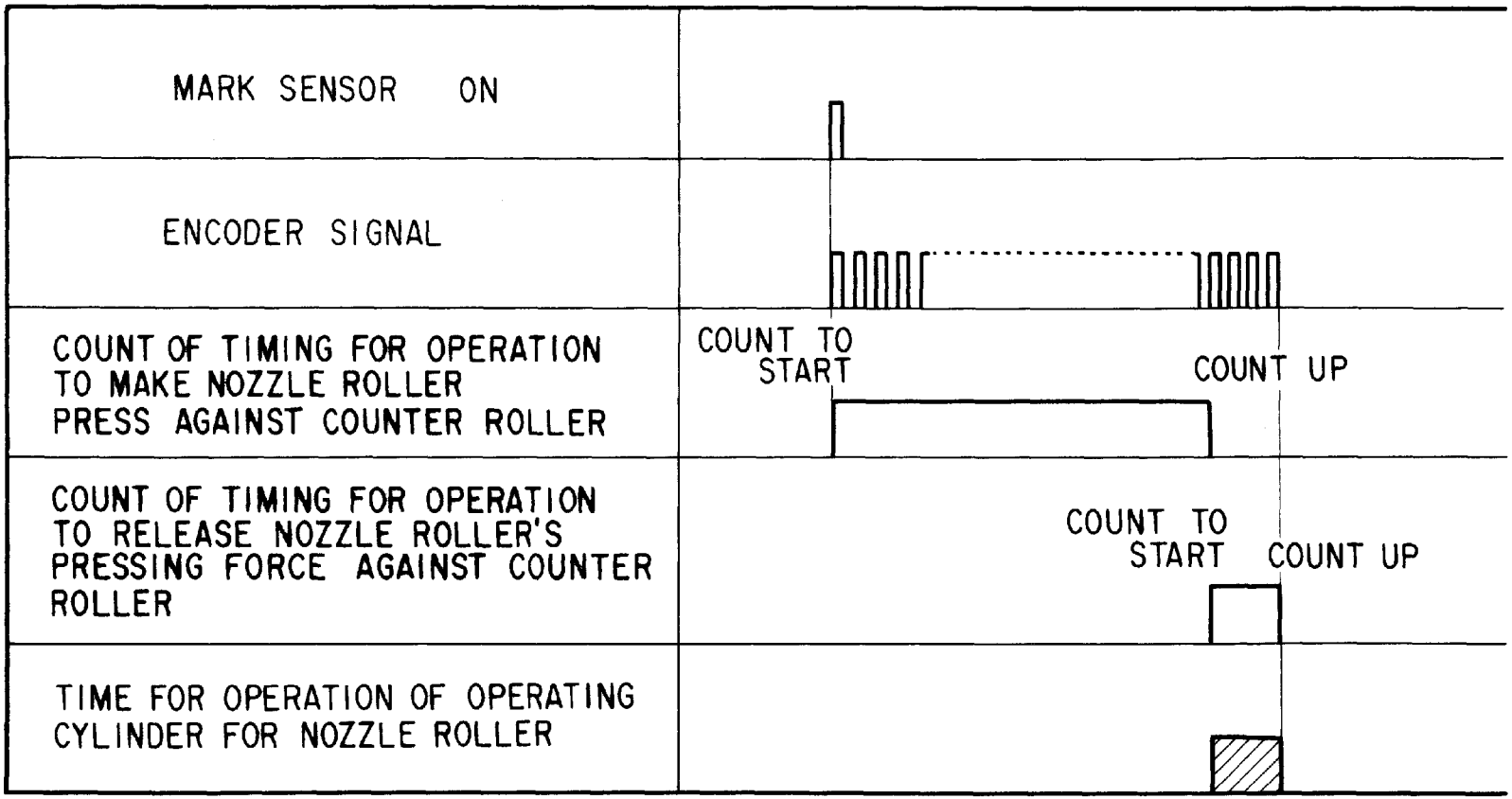
FIG. 10 is a timing chart for operation of the apparatus of FIG. 1.

In the embodiment mentioned above, FIG. 10 is a timing chart showing the pressing operation of the nozzle roller after the detection of the cut mark by the mark sensor, the non-pressing (releasing) operation of the nozzle roller, and the operation of the operation cylinder for the nozzle roller.

According to the present invention described above by way of the preferred embodiment, the continuous paper web can be bent and folded with no protuberant portion at the bent portion, and the set products discharged after the cutting do not provide any expanded or protuberant portion, thus providing a product with no curl. According to such merits, the operations and workings can be made easy and simple and members or parts to be used can be effectively reduced.

Further, it is self-evident to a person skilled in the art that although the present invention is described hereinbefore with reference to the exemplary embodiments, it is possible to make various changes, deletions and additions to the disclosed embodiment without departing from the subject and scope of the present invention. Accordingly, it is to be understood that the present invention is not limited to the described embodiments and includes scopes or its equivalent scope defined by the elements recited in the appended claims.

What is claimed is:

1. A paper web folding and cutting apparatus comprising:

a paper web traveling path along which a continuous paper web can travel at a predetermined traveling speed and in a paper web traveling direction;

a cutting assembly disposed along the paper web traveling path and adapted to form a line of cuts, having at least one uncut portion, at the top and bottom of each portion of the continuous paper web to be folded; and an oscillatory shooter assembly disposed along the paper web traveling path, said oscillatory shooter assembly being located downstream of said cutting assembly with respect to the paper web traveling direction, said oscillatory shooter assembly including a counter roller and a nozzle roller disposed at a lower end portion of said oscillatory shooter assembly, said counter and nozzle rollers being rotatable at a peripheral speed that is faster than the paper web traveling speed, said nozzle roller being movable into contact with said counter roller and away from said counter roller so as to be separated therefrom, said oscillatory shooter assembly being capable of moving in an oscillatory motion with the continuous paper web interposed between said nozzle roller and said counter roller so as to fold the continuous paper web in a zigzag fashion along each of the lines of cuts formed by said cutting assembly so that each fold coincides with one of the lines of cuts, wherein the continuous paper web is cut along one of the lines of cuts by moving the nozzle roller into contact with the counter roller when the one cut line approaches the vicinity of an upstream side of said nozzle roller and said counter roller.

2. A paper web folding and cutting apparatus as claimed in claim 1, wherein said cutting assembly comprises a cutting cylinder assembly disposed upstream of said oscillatory shooter assembly, said cutting cylinder assembly having a cutting cylinder and an impression cylinder disposed on opposite sides of the paper web traveling path, respectively.

3. A paper web folding and cutting apparatus as claimed in claim 2, wherein said impression cylinder and said cutting cylinder have substantially the same diameter and are rotated at a same peripheral speed in the paper web traveling direction with the continuous paper web being interposed between said impression cylinder and said cutting cylinder.

4. A paper web folding and cutting apparatus as claimed in claim 2, wherein said cutting cylinder includes a cylindrical member and a cutting blade extending longitudinally across said cylindrical member and projecting therefrom for forming each line of cuts along which the continuous paper web is folded and cut, said cutting blade being formed with at least one cutout for forming the at least one uncut portion in each line of cuts.

5. A paper web folding and cutting apparatus as claimed in claim 1, further comprising a frame member and a bearing means, wherein said nozzle roller is rotatably supported by said frame member through said bearing means, and a rotational center of said bearing means is offset relative to a rotational center of said nozzle roller.

6. A paper web folding and cutting apparatus as claimed in claim 1, further comprising a control means for controlling the timing at which said nozzle roller is pressed against said counter roller.

7. A paper web folding and cutting apparatus as claimed in claim 6, wherein said nozzle roller is pressed against the counter roller at a timing when a predetermined number of sheets of the continuous paper web are folded by the oscillatory shooter assembly.

8. A form printing press having a paper web folding and cutting apparatus comprising:

a paper web traveling path along which a continuous paper web can travel at a predetermined traveling speed and in a paper web traveling direction;

a cutting assembly disposed along the paper web traveling path and adapted to form a line of cuts, having at least one uncut portion, at every top and bottom of each portion of the continuous paper web to be folded, wherein said cutting assembly operates continuously as the continuous paper web travels along the paper web traveling path; and an oscillatory shooter assembly disposed along the paper web traveling path, said oscillatory shooter assembly being located downstream of said cutting assembly with respect to the paper web traveling direction, said oscillatory shooter assembly including a counter roller and a nozzle roller disposed at a lower end portion of said oscillatory shooter assembly, said countermand nozzle rollers being rotatable at a peripheral speed that is faster than the paper web traveling speed, said nozzle roller being movable into contact with said counter roller and away from said counter roller so as to be separated therefrom, said oscillatory shooter assembly being capable of moving in an oscillatory motion as the continuous paper web is interposed between said nozzle roller and said counter roller so as to fold the continuous paper web in a zigzag fashion along the cut lines formed by said cutting assembly so that each fold coincides with one of the cut lines, wherein the continuous paper web is cut along the cut lines by moving the nozzle roller into contact with the counter roller when one of the cut lines approaches an upstream side of said nozzle roller and said counter roller.

9. A form printing press having a paper web folding and cutting apparatus comprising:

means for feeding a non-perforated continuous paper web along a paper web traveling path such that the continuous paper web travels at a predetermined traveling speed and in a paper web traveling direction;

a cutting assembly disposed along the paper web traveling path and adapted to form a line of cuts in the non-perforated continuous paper web, the line of cuts having at least one uncut portion, at every top and bottom of each portion of the continuous paper web to be folded, wherein said cutting assembly operates continuously as the continuous paper web travels along the paper web traveling path;

a paper web guide assembly, disposed along the paper web traveling path immediately upstream of said cutting assembly, for guiding the non-perforated continuous web into said cutting assembly; and an oscillatory shooter assembly disposed along the paper web traveling path, said oscillatory shooter assembly being located downstream of said cutting assembly with respect to the paper web traveling direction, said oscillatory shooter assembly including a counter roller and a nozzle roller disposed at a lower end portion of said oscillatory shooter assembly, said counter and nozzle rollers being rotatable at a peripheral speed that is faster than the paper web traveling speed, said nozzle roller being movable into contact with said counter roller and away from said counter roller so as to be separated therefrom, said oscillatory shooter assembly being capable of moving in an oscillatory motion as the continuous paper web is interposed between said nozzle roller and said counter roller so as to fold the continuous paper web in a zigzag fashion along the cut lines formed by said cutting assembly so that each fold coincides with one of the cut lines, wherein the continuous paper web is cut along the cut lines by moving the nozzle roller into contact with the counter roller when one of the cut lines approaches an upstream side of said nozzle roller and said counter roller.

10. A form printing press as claimed in claim 9, further comprising a control means for controlling the timing at which said nozzle roller is pressed against said counter roller.

* * * * *